US010717112B2

(12) United States Patent
Bombaugh et al.

(10) Patent No.: US 10,717,112 B2
(45) Date of Patent: Jul. 21, 2020

(54) METHOD FOR SORTING RESIDUAL LETTERS AND FLATS TO CARRIER ROUTE SEGMENTS USING TWO PASSES ON A MACHINE WITH INTERMEDIATE STAGING

(71) Applicant: United States Postal Service, Washington, DC (US)

(72) Inventors: Scott R. Bombaugh, Burke, VA (US); Thomas J. Foti, Annandale, VA (US); David E. Loyd, Stafford, VA (US); Sarvang D. Shah, Fairfax, VA (US)

(73) Assignee: United States Postal Service, Washington, DC (US)

( * ) Notice: Subject to any disclaimer, the term of this patent is extended or adjusted under 35 U.S.C. 154(b) by 0 days.

(21) Appl. No.: 15/587,686

(22) Filed: May 5, 2017

(65) Prior Publication Data

US 2017/0320101 A1 Nov. 9, 2017

Related U.S. Application Data

(60) Provisional application No. 62/333,039, filed on May 6, 2016.

(51) Int. Cl.

| | |
|---|---|
| ***B07C 3/02*** | (2006.01) |
| ***B07C 3/00*** | (2006.01) |
| ***B07C 3/14*** | (2006.01) |

(52) U.S. Cl.

CPC ..... *B07C 3/005* (2013.01); *B07C 3/00* (2013.01); *B07C 3/14* (2013.01); *B07C 2301/0041* (2013.01)

(58) Field of Classification Search

CPC .. B07C 1/02; B07C 1/025; B07C 3/02; B07C 3/008; B07C 3/06; B07C 3/08;

(Continued)

(56) References Cited

U.S. PATENT DOCUMENTS 4,244,672 A 1/1981 Lund
4,388,994 A 6/1983 Suda et al.

(Continued)

FOREIGN PATENT DOCUMENTS

DE 10 200 022 082 A1 12/2010
EP 0 661 106 A2 7/1995

(Continued)

OTHER PUBLICATIONS

International Search Report and Written Opinion from the International Searching Authority dated Apr. 21, 2016 for International Application No. PCT/US2015/060724.

(Continued)

*Primary Examiner* — Joseph C Rodriguez

(74) *Attorney, Agent, or Firm* — Knobbe Martens Olson & Bear LLP

(57) ABSTRACT

Embodiments of a system and method for sorting and delivering articles in a processing facility. Delivery endpoints are divided and grouped into stop groups. A first sorter sorts items according to stop group and outputs the items to trays. The output trays from the first sorter are loaded to a second sorter. The second sorter sorts items for each stop group into trays based on carrier route segments. A manifest is created that comprises a list of the items in a tray. A mobile computing device alerts a delivery carrier when there is an item that needs to be delivered.

15 Claims, 6 Drawing Sheets

(58) Field of Classification Search
CPC .... B07C 2301/0041; B07C 2301/0066; B07C 2301/0083; B07C 3/003; B07C 3/006; B07C 3/14
See application file for complete search history.

(56) References Cited

U.S. PATENT DOCUMENTS

| | | | | |
|---|---|---|---|---|
| 5,277,321 | A | 1/1994 | Nagasawa et al. | |
| 5,363,971 | A | 11/1994 | Weeks et al. | |
| 5,385,243 | A | 1/1995 | Jackson et al. | |
| 5,433,325 | A | 7/1995 | Levaro et al. | |
| 5,542,547 | A | 8/1996 | Ricciardi | |
| 5,908,116 | A | 6/1999 | Levaro et al. | |
| 6,082,521 | A | 7/2000 | Maier et al. | |
| 6,208,910 | B1 * | 3/2001 | Michael | G07B 17/00024 700/215 |
| 6,321,992 | B1 | 11/2001 | Knowles et al. | |
| 6,366,828 | B1 | 4/2002 | De Leo et al. | |
| 6,533,271 | B1 | 3/2003 | Zimmermann | |
| 6,677,548 | B2 | 1/2004 | Robu et al. | |
| 6,786,404 | B1 * | 9/2004 | Bonner | B07C 3/00 235/385 |
| 6,881,916 | B2 | 4/2005 | McLaughlin et al. | |
| 6,978,192 | B2 | 12/2005 | Wisniewski | |
| 7,138,596 | B2 * | 11/2006 | Pippin | B07C 3/02 209/584 |
| 7,227,094 | B2 | 6/2007 | Oexle et al. | |
| 7,845,484 | B2 | 12/2010 | Zimmermann | |
| 8,178,811 | B2 | 5/2012 | Berdelle-Hilge | |
| 8,326,450 | B2 * | 12/2012 | Stemmle | B65H 29/003 700/213 |
| 8,369,985 | B2 | 2/2013 | Stemmle | |
| 8,374,720 | B2 | 2/2013 | Kechel | |
| 8,457,781 | B2 * | 6/2013 | Bailey | B07C 3/00 700/224 |
| 8,583,278 | B2 * | 11/2013 | Bretschneider | G06Q 50/32 700/224 |
| 8,731,707 | B2 | 5/2014 | Stemmle | |
| 8,766,128 | B2 | 7/2014 | Stemmle | |
| 8,772,664 | B2 * | 7/2014 | Zimmermann | B07C 3/02 209/583 |
| 8,827,065 | B2 | 9/2014 | Enenkel | |
| 8,965,566 | B2 | 2/2015 | Berdelle-Hilge | |
| 8,975,549 | B1 * | 3/2015 | Ward | B07C 3/02 209/584 |
| 8,997,971 | B2 | 4/2015 | Agier et al. | |
| 9,020,634 | B2 * | 4/2015 | Bailey | B07C 3/00 700/224 |
| 9,108,225 | B2 * | 8/2015 | Cartal | B07C 3/08 |
| 9,156,063 | B2 | 10/2015 | Bowers et al. | |
| 9,205,461 | B2 | 12/2015 | Norris et al. | |
| 9,278,376 | B2 | 3/2016 | McLaughlin et al. | |
| 9,314,822 | B2 | 4/2016 | Berdelle-Hilge | |
| 9,321,083 | B2 * | 4/2016 | Volta | B07C 7/005 |
| 9,415,422 | B2 | 8/2016 | Worth, II et al. | |
| 9,415,423 | B2 * | 8/2016 | Wilson | B07C 3/08 |
| 9,443,220 | B2 * | 9/2016 | Raney | G06Q 10/08 |
| 9,481,016 | B2 * | 11/2016 | Brown | G06Q 10/087 |
| 9,691,116 | B2 * | 6/2017 | Bonnell | B07C 3/18 |
| 9,845,194 | B2 | 12/2017 | Chirol et al. | |
| 9,849,487 | B2 * | 12/2017 | Bombaugh | B07C 3/02 |
| 10,220,416 | B2 | 3/2019 | Bomgaugh | |
| 2003/0141226 | A1 | 7/2003 | Morikawa | |
| 2004/0049315 | A1 * | 3/2004 | Sansone | G07B 17/00435 700/226 |
| 2006/0037888 | A1 | 2/2006 | Wheeler et al. | |
| 2008/0011653 | A1 | 1/2008 | Stemmle | |
| 2008/0087582 | A1 | 4/2008 | Zimmermann | |
| 2013/0035782 | A1 * | 2/2013 | Norris | B07C 3/00 700/224 |
| 2019/0105687 | A1 | 4/2019 | Bombaugh | |

FOREIGN PATENT DOCUMENTS

| | | |
|---|---|---|
| EP | 1 872 866 A2 | 1/2008 |
| EP | 2 226 130 A1 | 9/2010 |
| FR | 2 647 425 A1 | 11/1990 |

OTHER PUBLICATIONS

International Search Report and Written Opinion dated Sep. 19, 2017 for International Application No. PCT/US2017/031016.

* cited by examiner

METHOD FOR SORTING RESIDUAL LETTERS AND FLATS TO CARRIER ROUTE SEGMENTS USING TWO PASSES ON A MACHINE WITH INTERMEDIATE STAGING

INCORPORATION BY REFERENCE TO PRIORITY APPLICATIONS

Any and all applications for which a foreign or domestic priority claim is identified in the Application Data Sheet as filed with the present application are hereby incorporated by reference under 37 CFR 1.57. This application claims the benefit of priority to U.S. Provisional Application 62/333,039, filed 6 May 2016, the entire contents of which are incorporated in their entirety.

BACKGROUND

Field

The disclosure relates to sorting a plurality of items. More specifically, it relates to systems and methods for high throughput sorting of items to a plurality of destinations.

Description of the Related Technology

Items, such as articles of mail, which can include letters, flats, parcels, and the like, warehouse inventories, packages, or parcels are frequently received into a processing facility in bulk, and must be sorted into particular groups to facilitate further processes such as, for example, delivery of the item to a specified destination. The particular groups can correspond to specific types or categories of items, groupings of items that require similar further processing, or other types of groups depending on the specific application. Sorting bulk stacks of items or articles can be done using sorting apparatuses. The sorting apparatuses and the bulk mail take up space in a processing facility, which may be at a premium. The high volume of items processed and sorted increases the cost and complexity of the sorting means and methods involved. Inefficient sorting systems and methods can lead to significant losses of time and/or cost over the course of a day or year.

Mail delivery is merely one example of an industrial application that relies on sorting and processing large quantities of items. Others may include, but are not limited to, retail operations with large inventories and high daily sales, high volume component manufacturers, such as consumer goods, baggage sorting, and importing operations with high volumes of imports needing sorting and receiving daily.

SUMMARY

In one aspect described herein, a system for sorting and delivering items comprises a sorter comprising a first scanner configured to scan a plurality items and identify a destination for each of the plurality of items; a processor in communication with the first scanner, and configured to associate the identified destination for the for each of the plurality of items with one of a plurality of stop groups; and a sorting portion configured to receive items from the scanner, and sort the plurality of items into a plurality of bins according to the associated stop groups; and a memory configured to store the location of the plurality of items in the plurality of bins.

In some embodiments, the sorting portion comprises an output sorter configured to select a leading item from the scanner and direct the item toward the plurality of bins.

In some embodiments, the processor is configured to store a sequence of the destinations for the plurality of items, and to receive the associated stop group for each of the plurality of the items, and to control the output sorter to sort the plurality of items to one of the one or more bins according to the stop group associated for each of the plurality of items.

In some embodiments, the stored sequence of destinations is a walk sequence order.

In some embodiments, the output sorter is configured to sort items associated with one or more stop groups into one of the plurality of bins.

In some embodiments, the system further comprises a database comprising a processor; and a memory.

In another aspect described herein, a method of sorting and delivering items comprises assigning, in a processor, a plurality of delivery end points to a plurality of stop groups; sorting the plurality of items on a sorting apparatus according to the assigned stop groups; moving the sorted items into one or more trays according to the stop groups; storing an association between the sorted items and the tray in which the sorted items are stored; moving the one or more trays into a storage location; and storing a location identifier for the one or more trays corresponding to a location of the one or more trays within the storage location; selecting one of the one or more trays according to a stop group order based on the stored association between the sorted items and the tray in which the sorted items are stored; loading the items from the selected one or more trays into a second sorting apparatus; sorting the items corresponding to a first one of the plurality of stop groups into a first selected bin of a plurality of bins and the items corresponding to a second one of the one or more stop groups into a second selected bin of a the plurality of bins; storing an association between the sorted items and the bin in which the sorted items are sorted; determining a location of a mobile computing device; determining a selected item from the sorted items needs to be delivered; and displaying an alert on the mobile computing device that the selected item needs to be delivered.

In some embodiments, the method further comprises delivering the selected item to a delivery end point associated with the selected item.

In some embodiments, displaying an alert on the mobile computing device comprises displaying information associated with the selected item.

In another aspect described herein, a system of sorting and delivering items comprises means for assigning a plurality of delivery end points to a plurality of stop groups; means for sorting the plurality of items on a sorting apparatus according to the assigned stop groups; means for moving the sorted items into one or more trays according to the stop groups; means for storing an association between the sorted items and the tray in which the sorted items are stored; means for moving the one or more trays into a storage location; and means for storing a location identifier for the one or more trays corresponding to a location of the one or more trays within the storage location selecting one of the one or more trays according to a stop group order based on the stored association between the sorted items and the tray in which the sorted items are stored; means for loading the items from the selected one or more trays into a second sorting apparatus; means for sorting the items corresponding to a first one of the plurality of stop groups into a first selected bin of a plurality of bins and the items corresponding to a second one of the one or more stop groups into a second selected bin of a the plurality of bins; means for storing an association between the sorted items and the bin in which the sorted items are sorted; means for determining a location of a mobile computing device; means for determining a selected item from the sorted items needs to be delivered; and means for displaying an alert on the mobile computing device that the selected item needs to be delivered.

BRIEF DESCRIPTION OF THE DRAWINGS

The foregoing and other features of the disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings.

DETAILED DESCRIPTION

Figure 1:
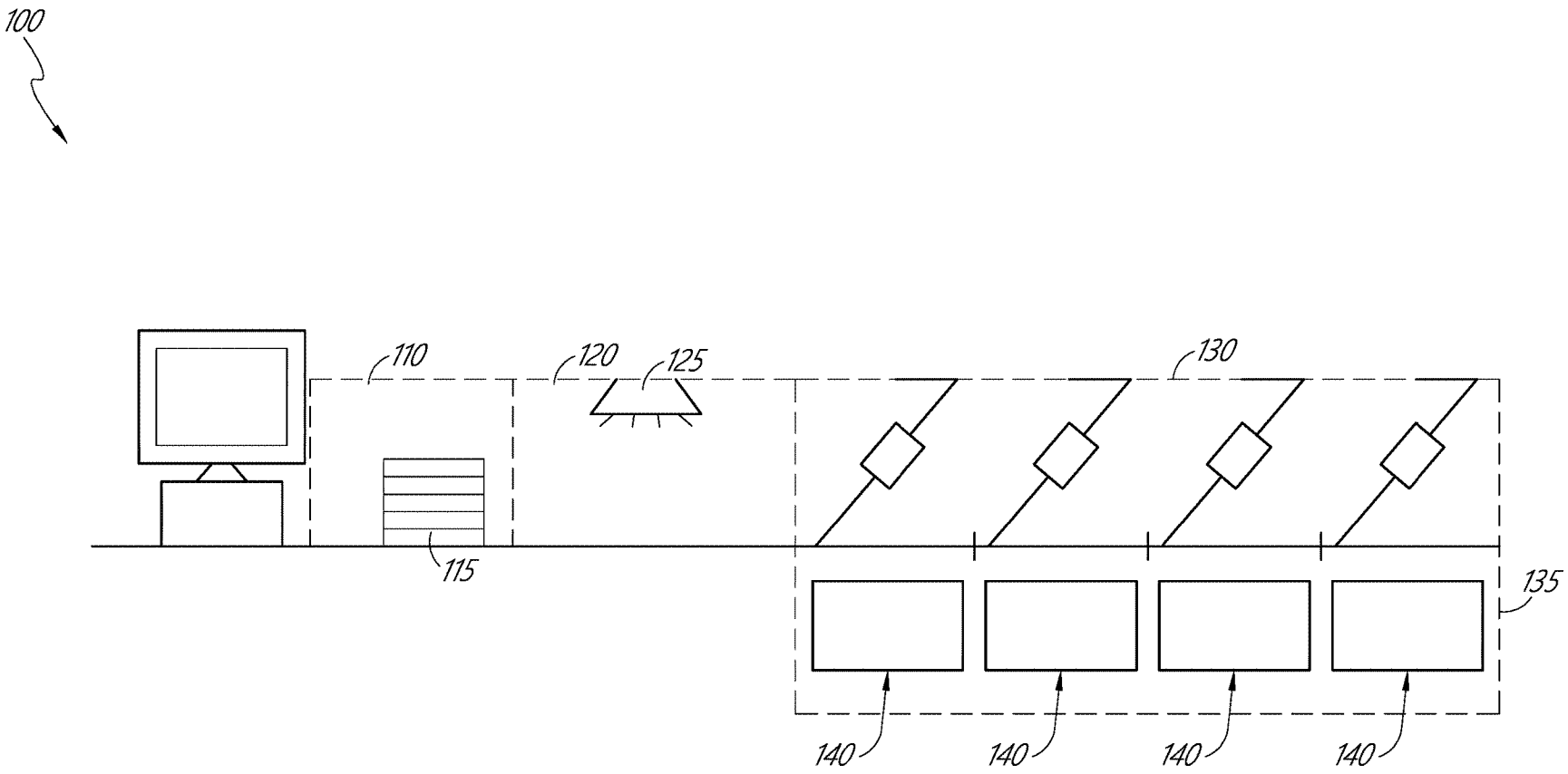
FIG. 1 is a perspective view of an embodiment of sorting equipment.

The embodiments disclosed herein each have several aspects no single one of which is solely responsible for the disclosure's desirable attributes. Without limiting the scope of this disclosure, its more prominent features will now be briefly discussed. After considering this discussion, one will understand how the features of the embodiments described herein provide advantages over existing systems, devices and methods for receiving items.

In the following detailed description, reference is made to the accompanying drawings, which form a part hereof. In the drawings, similar symbols typically identify similar components, unless context dictates otherwise. Thus, in some embodiments, part numbers may be used for similar components in multiple figures, or part numbers may vary depending from figure to figure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and made part of this disclosure.

Reference in the specification to "one embodiment," "an embodiment," or "in some embodiments" means that a particular feature, structure, or characteristic described in connection with the embodiment is included in at least one embodiment of the invention. Moreover, the appearance of these or similar phrases throughout the specification do not necessarily all refer to the same embodiment, nor are separate or alternative embodiments necessarily mutually exclusive. Various features are described herein which may be exhibited by some embodiments and not by others. Similarly, various requirements are described which may be requirements for some embodiments but may not be requirements for other embodiments.

The system described herein provides for faster and more efficient sorting of bulk items, such as, for example, articles of mail. The articles of mail for sorting may include items of various size and shape, such as letters, flats, parcels, rolls, and pharmaceuticals. Articles of mail such as magazines and catalogs, which are too long in one direction to be considered a standard sized letter, are often called flats. Flats are often flexible and may sometimes be flimsy, which can cause problems in automatic stack feeders during singulation. Flats may be received in a processing facility in bulk, separate from letters or other articles of mail. Some items cannot be sorted by pinch belt letter sorters or flat sorting automation. These items, referred to as residual mail, may be items which cannot be physically processed on pinch-belt type sorters because they are too large, bulky, irregularly shaped, or otherwise incompatible with such a sorter. Some items of residual mail may be those which have been rejected out of the equipment for address recognition reasons, inability to read information on the item, sorting machine error, or other reason. Residual mail still must be sorted, and is sorted on a residual mail sorting apparatus. As used herein in, the term processing facility may refer to a regional distribution facility, a hub, or a delivery unit facility.

Items, including flats, letters, parcels, residual mail, and the like are processed to sort the items into desired groups, such as a group intended for a particular geographic area or to a delivery unit, according to delivery route segments, or into delivery sequence order. The delivery sequence order can be the order in which a carrier navigates his or her delivery route, such as the order in which the carrier visits delivery points, such as addresses, along the carrier's delivery route. A delivery route segment is a sequential subset of delivery points on a delivery route. By using a combination of new machines and sorting methods, the footprint of items, processing and sorting equipment, and other machines can be reduced, number of touches of an item can be reduced, machine run time can be optimized, and delivery resources can be used efficiently.

As used herein, the term "stack" may mean a plurality of items, such as letters or flats, which have not been separated into individual pieces or singulated. A plurality of letters retrieved from a tray or bin can be loaded into a sorting machine as a stack. As used herein, the term singulation may mean the separation of a stack of articles into individual articles that move into a sorting or picking machine in a line of single articles. The term motor is used herein to refer to any device which provides a mechanical or electrical motive force to a component of the processing equipment in a processing facility. The motors described herein may be mechanically or electrically driven, or may be a source of pneumatic or hydraulic pressure, or may be any other types of motor.

Although the present disclosure describes systems and devices for sorting and/or singulating articles of mail, such as letters and flats, it will be apparent to one of skill in the art that the disclosure presented herein is not limited thereto. For example, the development described herein may have application in a variety of manufacturing, assembly, distribution, or sorting applications.

Sorting may be required at any one of a plurality of different levels present in a distribution network. A distribution network as described herein may comprise multiple levels. For example, a distribution network may comprise processing facilities such as regional distribution facilities, hubs, and delivery unit facilities, and other desired levels. For example, a nationwide distribution network may comprise one or more regional distribution facilities having a defined coverage area (such as a geographic area), designated to receive items from intake facilities within the defined coverage area, or from other regional distribution facilities. The regional distribution facility can sort items for delivery to another regional distribution facility, or to a hub level facility within the regional distributional facility's coverage area. A regional distribution facility can have one or more hub level facilities within its defined coverage area. A hub level facility can be affiliated with a few or with many delivery unit facilities, and can sort and deliver items to the delivery unit facilities with which it is associated. In the case of the United States Postal Service, the delivery unit facility may be associated with one or more ZIP codes. The delivery unit facility receives items from local senders, and from hub level facilities or regional distribution facilities. The delivery unit facility also sorts and stages the items intended for delivery to destinations within the delivery unit facility's coverage area. The delivery unit facility may be associated with one or more delivery routes. A delivery route may comprise one or more route segments. As described above, sorting of the items occurs at each level in the network and thus improving sorting efficiency can affect the efficient operation of the distribution network generally.

In a distribution network, items for delivery are brought into a processing facility. In the processing facility, items are processed in preparation for the next stage in the delivery scheme. Incoming items into a processing facility may not be sorted or sequenced, and may be randomly ordered. Therefore, sorting is required at the processing facility to sort items according to the next stage in the delivery scheme. Where the processing facility is a delivery unit facility, for example, the items must be sorted into delivery routes and/or into delivery route segments.

At each level, items can be sorted according to item type, delivery end point, class of service, or any other criteria. Items which are intended for delivery within a defined geographic area near the processing facility, or intended for delivery to a particular destination or plurality of destinations, can be sorted by separating these items from items with other, different delivery end points. Items intended for delivery to a destination outside of the defined geographic area, particular destination or plurality of destinations can be processed and/or sent to another processing facility nearer their delivery end points.

Where items are intended for delivery within a defined geographic area or to a specific plurality of destinations, such as at a delivery unit facility, the items can be sequenced into a specific order, such as into delivery sequence order. A delivery sequence order can correlate to a particular delivery route which is serviced by a particular delivery resource, such as a carrier or vehicle. In this case, the delivery sequence order corresponds to the order in which delivery end points, such as addresses, are encountered as the delivery resource or carrier follows the particular delivery route. Where the items are mail pieces, the delivery sequence order corresponds to the addresses encountered as the mail carrier walks and/or drives his route. For example, the first house a carrier encounters on his delivery route may be assigned a delivery end point value of "1." The second house the carrier encounters on his delivery route may be assigned a delivery end point value of "2," and so on throughout the delivery route. In some embodiments, the delivery end point values may start at any number, and may increment by 1 as each subsequent delivery end point is encountered. Other values, such as alphanumeric codes and the like can be used for the delivery end point values.

A processing facility, such as a unit delivery facility, may service one or more delivery routes. In this case, sorting and sequencing items may be facilitated by assigning each delivery end point to a stop group as an intermediate step to sequencing according to delivery sequence order or sorting to route segment level. A stop group is a group of one or more delivery end points that are grouped together for purposes of sorting and sequencing. A route segment is a sequential subset of delivery end points along a delivery route. For example, where a processing facility, such as a regional distribution facility, services 100 delivery routes, each delivery route having 6 route segments, each route segment having 10 delivery end points, a total of 600 route segments and 6,000 delivery end points are serviced by the processing facility. The 6,000 delivery end points serviced by the processing facility are grouped into stop groups. A stop group may comprise a grouping of one or more of the 6,000 delivery end points. For example, a stop group may comprise one or more route segments of a delivery route, or may comprise one or more route segments from more than one delivery route. In some embodiments, a stop group may comprise at least one delivery route. In some embodiments, a stop group may be a combination of delivery end points from one or more of the 100 delivery routes.

Sorting and sequencing items may be facilitated by assigning each delivery route to a wave as an intermediate step to sorting according to delivery sequence order. A wave may be a group of one or more delivery routes that are grouped together for purposes of sorting and sequencing. For example, a processing facility, such as a unit delivery facility or a regional distribution facility, may service 100 delivery routes. The 100 delivery routes serviced by the processing facility may be grouped into waves. A wave may comprise a grouping of one or more of the 100 delivery routes, for example, a wave may comprise 10 delivery routes.

A processing facility may use automated processing equipment to sort items. Where the distribution network is the United States Postal Service (USPS), every day a processing facility receives a very high volume of items, such as letters, flats, parcels, packages, and residual mail pieces, which must be sorted and sequenced for delivery. Sorting and sequencing is accomplished using automated sorting equipment which can scan, read, or otherwise interpret a destination end point located on or associated with each item processed. The destination end point may be encoded in a computer readable code, such as a bar code printed on or affixed to the item. In some embodiments, the destination end point may be read by taking an image of the item and performing an optical character recognition (OCR) process on the image, and determining the delivery end point from the OCR'd address. In some embodiments, the automated sorting equipment can apply a computer readable code that encodes the delivery end point to the item. In some embodiments, the processing facility uses sorting/sequencing apparatuses which can process 30,000 items per hour. A typical USPS processing facility may also serve 200 or more delivery routes, each with multiple delivery end points. Because of the high volume of mail and the large number of delivery routes, the processing facility must use large equipment which may have a large footprint within the processing facility.

Sorting a plurality of items may comprise at least one pass. A pass occurs when items are passed through the sorting or processing equipment one time. A first pass can sort the items to a greater or lesser extent, such as a coarse or preliminary sort according to a defined sort plan, and based on the availability of bins, trays, or stackers on the processing and sorting equipment. A second pass may occur when items that have already been sorted by the sorting equipment are passed through the sorting equipment a second time. The items being sorted in the second pass may include all the items from the first pass, some of the items from the first pass, and/or new items that were not sorted in the first pass. The sorting equipment sorts the items and distributes them into bins or another type of receptacle for receiving items, such as, a bag, sack, tray, pallet, etc. Once a pass is complete, the bins may need to be emptied before a next pass is started. In some embodiments, the process of emptying bins may be done manually. In some embodiments, the process of emptying bins may be automated or semi-automated. For example, the receptacle may be rotatable so that when a receptacle is full, the receptacle is rotated to position an empty receptacle into a position at the output of the sorting equipment. A receptacle can comprise one or more receptacle bins, which, when rotated place one of the one or more bins in position at the output of the sorting equipment. In some embodiments, after rotation, a full receptacle bin of the receptacle can be emptied while the empty receptacle bin of the receptacle receives items from the sorting equipment. This would reduce the time needed to clear the sorting equipment between passes, reduce sorting time, and maximize delivery resources.

In some embodiments, the sorted items need not be in delivery order sequence when sent out for delivery. This can save production time by not requiring another pass through the machines. This can save the delivery carrier office time by not requiring the delivery carrier to manually sort items before he or she begins the delivery route. At least one smart card may be created to identify the sorted items. A smart card may be created to identify the items sorted into each bin or other type of receptacle for receiving items. A separate smart card may be created for each bin. The smart card may be created after the first or second pass. The smart card may be created by the sorting machine or by a separate machine. The smart card may be added to the sorted items manually or via automation. The smart card includes information about the sorted items, such as but not limited to: the delivery end point, number of items for each delivery end point, the position or relative position (front, middle, back) of an item within the stack, the total number of items in the stack, customer information, route information, the name of the addressee, special services requested, type of item, description of item, etc. The smart card identifies where in the stack each item is. For example, the position of an item may be identified as front, middle, or back, indicating to the delivery carrier to look for that the item closer to the front, middle, or back of the stack. As items are delivered, the stack decreases in size. In some embodiments, the location of the item in the stack may be identified by a number or other indication of position. For example, the number may indicate that an item is the first or tenth item in the stack. The smart card may be disposable or may be reusable.

The smart card can be generated automatically by the sorting equipment following the sorting, and can be injected into a bin by the sorting equipment. In some embodiments, the information for a smart card can be sent to a mobile delivery device of a carrier.

A mobile device may be used by a delivery carrier. The mobile device may use multiple wireless networks for digital tracking of deliveries. The mobile device may allow the carriers to enter information, such as stopping points or deliveries made. The mobile device may store a manifest of items, which includes, but is not limited to, a list of items to be delivered, delivery addresses of the items, customer information, etc. The mobile device may connect to a database that stores a manifest which includes, but is not limited to, a list of items to be delivered, delivery addresses of the items, customer information, etc. The manifest stored on the mobile device may comprise information for items intended for delivery along a route assigned to the carrier assigned to the mobile device, or to whom the mobile device is assigned.

A sculch tray may be used by a carrier. A sculch tray is a portable tray with dividers dividing the tray into multiple compartments. A sculch tray may be used to store residual mail and may be placed in the delivery vehicle for the carrier to take on the delivery route. A sculch tray can be used to separate items within the tray. For example, the sculch tray may be used to keep the residual mail separate from other mail. A carrier may merge the residual mail with the other mail or keep the mail separate. This can be useful as the processing or sorting equipment may sort letters and flats separately from parcels or residual mail. Thus, a carrier may have items for delivery along the carrier's route coming from two sources, or two different sorting machines. The sculch tray allows for a carrier to keep items from different sorting apparatuses separate in a common location. A smart card may be added to the skulch tray. There may be at least one smart card per skulch tray. For example, there may be one smart card per delivery route. In some embodiments, there may be one smart card per delivery route segment, resulting in more than one smart card per delivery route. A smart card may be positioned in with the residual mail, other mail, or both.

The systems and methods described herein are useful for efficiently and quickly sorting items and may be included at any level of the distribution network described above, or in any other application or operation requiring sorting of items.

An example of sorting equipment that may be used in some embodiments is depicted in FIG. 1. FIG. 1 is a block diagram of an embodiment of a sorter 100 for sorting a plurality of items 115 into a set of dedicated bins 140. Sorter 100 includes an intake system 110. The intake system 110 may be a counter or other receiving structure where a stack of items 115, such as letters and flats, are brought to be fed into the sorter 100. The intake system 110 may provide a surface or surfaces on which to place the stack of items 115 to stage the items for processing. The intake system 110 may include an automated feed area and/or a manual feed area. The sorter 100 system has a scanning portion 120 that includes a scanner 125 which scans or reads a computer readable code or performs OCR of an image of part or all of an item 115 in order to identify various characteristics of the item(s) 115, such as class of service, addressee, and/or delivery end point.

The sorter 100 further includes a sorting portion 130. The sorting portion 130 which has various components (not shown), for directing items 115 along particular pathways as the items 115 are sorted. The sorting portion 130 may be a conveyor or carousel configured to move the plurality of items 115 around the sorting portion 130. The sorting portion 130 may be located adjacent to or otherwise near the intake system 110 or the scanning portion 120. In some embodiments, the items 115 may be moved or transported from the intake system 120 to the sorting portion 130 by an automated system including series of vacuum belts, tilt trays, cross belts, bomb-bay style trap doors, or other conveying mechanisms. As the items are moved or transported from the intake system 120 to the sorting portion 130, the items are read or scanned, and destinations identified for each individual item 115. The processor then operates a system of motors, conveyors, and belts to direct the item to the stacker portion 135.

The sorter 100 includes a processor configured to control the operation of the sorter 100, including controlling the movement of items through the sorting portion 130 via conveyors, belts, and/or motors, controlling the scanning portion 120 to facilitate the intake, sorting, and sequencing the items 115 according to a sort plan stored in memory. The sort plan can be established prior to the first pass of sorting items, and can be formed for various levels of the distribution network. The sort plan can detail how to sort items according to their intended destinations, according to the facility housing the sorting equipment, and according to a class of service of the items. For example, at a unit delivery facility, the sort plan assigns each destination or delivery point to a carrier or delivery route, to a route segment, and a stop group. As the sorting or processing equipment reads a delivery destination from an item, the processor references the sort plan to determine how to route the item through the sorting or processing equipment, such as to the stacker, tray, or bin assigned for each delivery route, route segment, or stop group.

The processor also stores information obtained by the scanner for further use. The memory can be part of the sorter 100, or may be remote to the sorter 100. The memory may be on a network with which the processor can communicate, and the memory may be shared by different components within a processing facility. The memory is configured to store information related to the identity of each article processed, including information obtained from a manifest or from the scanner including information scanned, read, or interpreted from the letter, such as delivery end point, sender, class of service, postage, serial number, and the like. The memory is also configured to store the sequence of items in the item stream as they are scanned. The processor also stores in memory which bin 140 the item was routed.

The sorter 100 may further include a printing portion. The printing portion may communicate with the processor to print a smart card. The processor takes some or all of the information stored in memory to create a smart card. A smart card may be made for each bin 140. The smart card may identify the items in the bin and the position or relative position of each item in the bin. The smart card may go through stacker portion 135 and be sorted into specific bins. In some embodiments, the smarts cards are made by a machine separate from the sorter 100. In some embodiments, the smart cards do not go through the stacker portion 135 and are added to the bins 140 separate from the stacker portion 135, such as when the bins 140 are unloaded into trays.

The stacker portion 135 may be a structural system having a plurality of bins 140 arrayed, in some embodiments, below the sorting portion 130. The bins 140 may be any type of receptacle for holding sorted items and may be specifically configured and adapted by one of ordinary skill in the art to be particularly suited to the types of items being sorted. Each bin 140 is configured to receive one or more items 115 from the sorting portion 130. Each bin 140 may be assigned to a particular wave, delivery route, or to one or more stop groups. This process will be described in greater detail below.

Where each bin 140 may be assigned to a delivery route, if the number of delivery routes is large, the number of bins 140 in the stacker portion 135 must also be large to contain the large number of bins 140. One aspect of the present application describes systems and methods which reduce the number of bins 140 required on a sorter 100, and thereby reduce the footprint of the sorter 100.

The items from each bin 140 may be automatically or manually loaded into sculch trays manually. The sculch tray can be transported to a delivery unit facility, to the delivery carrier, onto a vehicle, or to any other desired location. Among other advantages, the systems and methods described herein can reduce the time a delivery carrier is at the facility, and thereby optimize the use of delivery resources.

Figure 2:
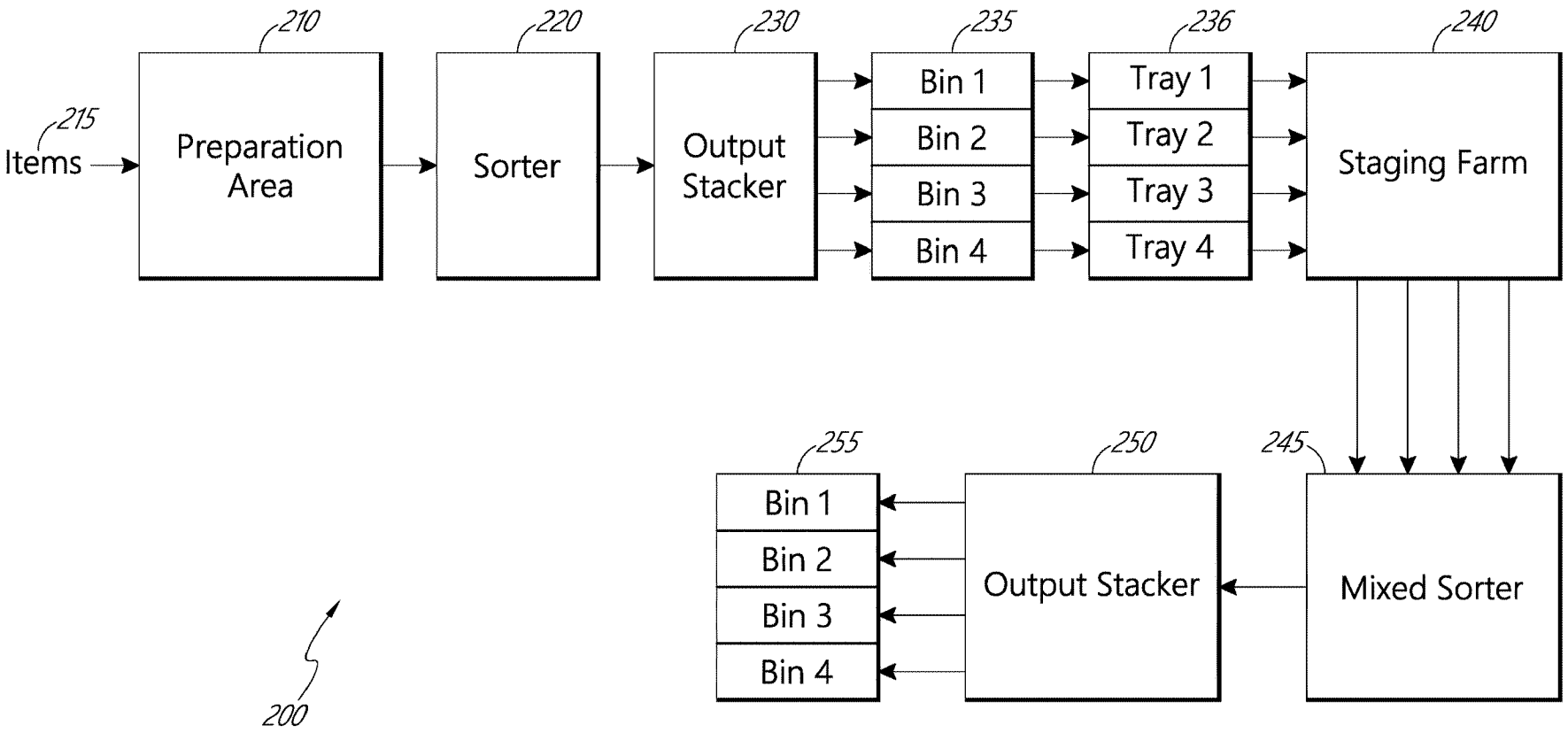
FIG. 2 is a block diagram of a processing facility flow.

FIG. 2 is a block diagram of an embodiment of a process flow in a processing facility. Facility 200 can comprise a preparation area 210, a sorter 220, an output stacker 230, bins 235, a staging farm 240, a mixed sorter 245, an output stacker 250, and bins 255.

The sorter 220 and the mixed sorter 245 may be similar to the sorter 100 described with regard to FIG. 1. The preparation area 210, output stacker 230, and bins 235 may be part of the sorter 220. In some embodiments, the mixed sorter 245 may be similar to the product called the Mixed Mail Sorter (MSA-9600) manufactured or sold by Neopost or its affiliates. In some embodiments, the sorter 220 and the mixed sorter 245 may be the same type of machine. In some embodiments, the sorter 220 and the mixed sorter 245 may be different types of machines. In some embodiments, there is a single sorter used, and items are processed in more than one pass on the sorter 220. In some embodiments, the sorter 330 and/or the mixed sorter 245 may include a printing portion that creates a smart card. In some embodiments, a separate machine may create the smart cards.

The staging farm 240 includes storage space to store trays, items, pallets, and bins, according to a staging plan. The staging farm can include automated storage and retrieval devices such as automated vehicles, cranes, and the like. In some embodiments, the staging farm 240 includes robotic vehicles, and robotic picking systems having overhead gantries, or the like. In some embodiments, the robotic picking system may be similar to the multipack robotic manufactured or sold by Cimcorp.

The output stacker 250 and bins 255 may be part of the mixed sorter 245 and may include bins or stackers as described elsewhere herein. In some embodiments, the output stacker 250 may comprise a separate stacker or plurality of bins connected to the mixed sorter 245 via conveyors or belts.

As a brief overview of the operations of the processing facility 200, items 215, such as letters, parcels, residual mail, packages, and flats, are received into a processing facility 200, as item input. Some of these items may not be compatible with traditional pinch belt sorters, such as residual mail, parcels, and packages. These items may have been rejected from the traditional letter sorter or flat sorting automation due to mechanical incompatibility, due to the item's thickness, abnormal dimensions, or contoured surfaces, or due to address recognition problems. In some embodiments, the items 215 which have been rejected from traditional letter sorter or flat sorting automation are received into the sorter 220. The sorter 220 performs a first pass sorting according to criteria set in the sort plan, such as according to wave, delivery route, or stop group, of the sorter 220. The items 215 are sorted according to the criteria and stored in one or more bins 235 connected to the output stacker 230. The items 215 can be removed from the bins 235 and be swept, via an automated arm, robot, or mechanical means, or otherwise put into trays 236. As used herein, a bin and/or tray can refer to a specific type of receptacle adapted for use with a sorter 220 described herein, or can be any other type of container capable of receiving and containing a plurality of items.

Figure 6:
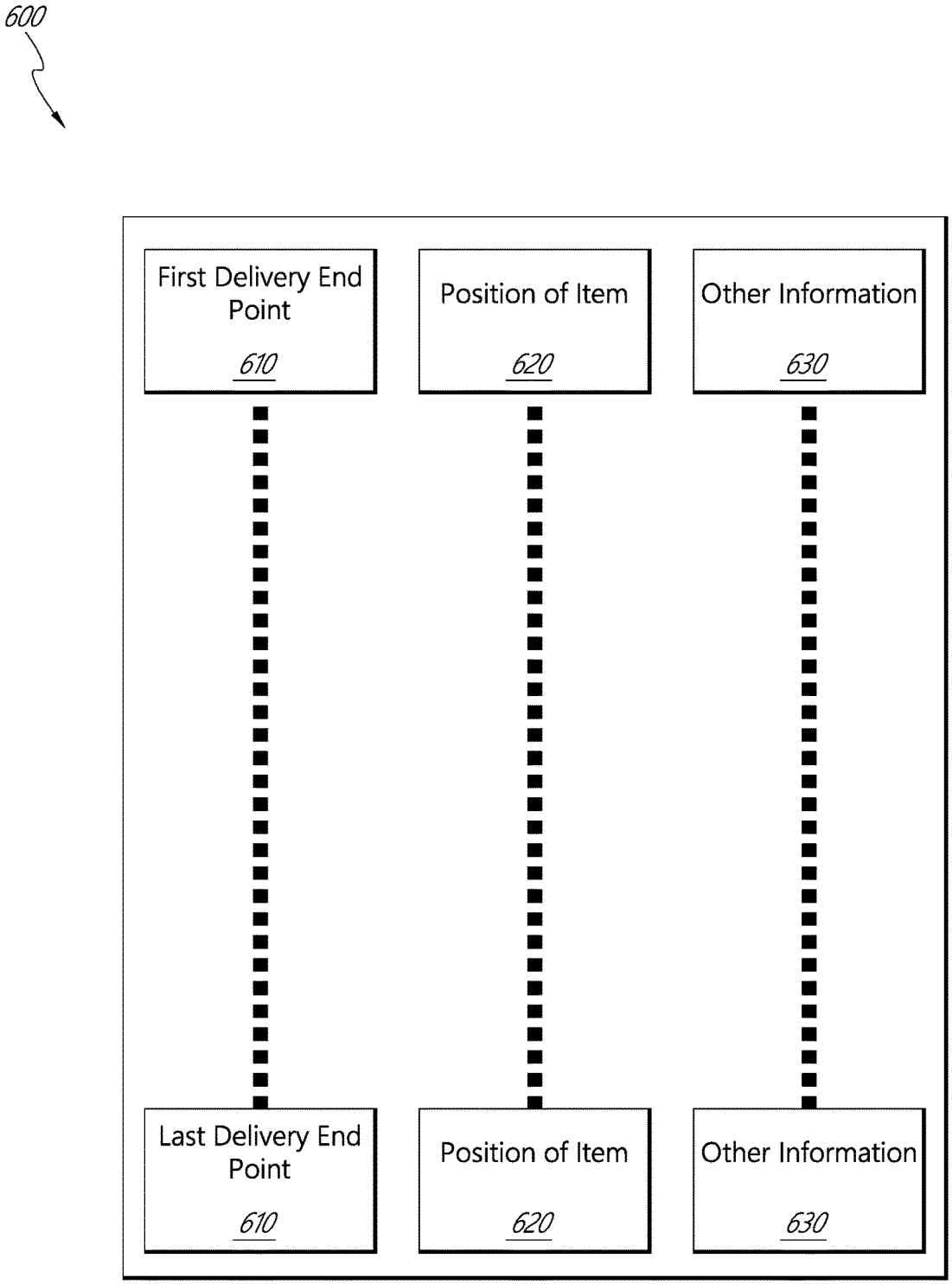
FIG. 6 is diagram of an embodiment of a smart separator card.

In some embodiments, at least one tray 236 may be delivered without a second sorting pass. The items in tray 236 may be in any desired order resulting from the sort (e.g., depth of sort) from the first pass. A smart card, as shown in FIG. 6, may be created and added to tray 236 to identify the items and the position of each item in the tray 236. For example, the sorter 220 will know what order the sorted items 215 are in, and can output this information to a smart card. During delivery, the delivery carrier may reference the smart card to identify and locate items within a tray or within a vehicle, to be delivered.

The trays 236 are moved from the sorter 220 to the staging farm 240 to await a second sorting pass or to await delivery. The trays 236 may be moved using a robotic tray handling system from the staging farm 240. The tray handling system can move the trays 236 along the paths between components depicted in FIG. 2. The trays 236 may comprise computer readable identifiers provided to track the contents of the trays and to store the location of the tray within the storage farm in the memory. This allows specific trays 236 to be retrieved by an automated system as required for a second or additional sorting pass. The identifiers may include information indicating the bin 235 from which the items were taken and the location of trays 236 in the staging farm 240. The tray handling system includes a processor (not illustrated) and a memory (not illustrated) to track the contents and location of each tray 236 for efficient storage in and retrieval from the staging farm 240.

Trays 236 are obtained by the tray handling system from the staging farm 240 in a particular order or sequence, as required, as will be described in greater detail below, and are fed into a mixed sorter 245. The mixed sorter 245 may be similar to the sorter 220. The mixed sorter 245 may be the sorter 220, such that the same machine is used for multiple passes. In the case that the same machine is used, the stackers or bins of the machine must be emptied in between runs.

The mixed sorter 245 receives items 215 from the staging farm 240 and outputs a single stream into the output stacker 250. In some embodiments, the output stacker 250 may comprise a plurality of bins 255.

The process of sorting articles in the processing facility 200 will be further described with reference to FIGS. 2 and 3. A two-pass sorting system may be used advantageously to reduce the number of touches on items, the time carriers spend in the facility, the size of processing equipment in a processing facility, and equipment run-time and operating expense, to improve delivery performance, and generally to use more efficiently the processing equipment. The USPS will be used as an example to describe the process of sorting articles, but the present disclosure is not limited thereto.

A tray, pallet, bin, sack, or other bulk collection of items, for example, letters and flats, is received in the processing facility 200, illustrated in FIG. 2. The processing facility may be a USPS delivery unit facility which, for example, services 8 delivery routes, each of which includes 2 route segments, each route segment including 3 delivery end points, or addresses, for a total of 48 destinations. These numbers are exemplary only, and the scope of the present disclosure is not limited thereto.

A first pass at sorting the items is performed, which may sort or divide the items 215 into waves. In the USPS example, the 48 delivery end points, or addresses, are divided into 4 waves. A wave may correspond to one or more delivery routes. In the embodiment illustrated in FIG. 3, each wave corresponds to two delivery routes. In some embodiments, the waves may have assigned different numbers of delivery routes, for example, wave 1 could correspond to two delivery routes, wave 2 to two delivery routes, wave 3 to two delivery routes, and wave 4 to two delivery routes, for a total of eight delivery routes. In some embodiments, the number of delivery routes assigned to each wave can vary according to the number of destinations or delivery points on a route. For example, delivery routes may have different numbers of destinations or delivery points. The sort plan may divide the number of destinations or delivery points evenly among the selected waves.

Figure 3:
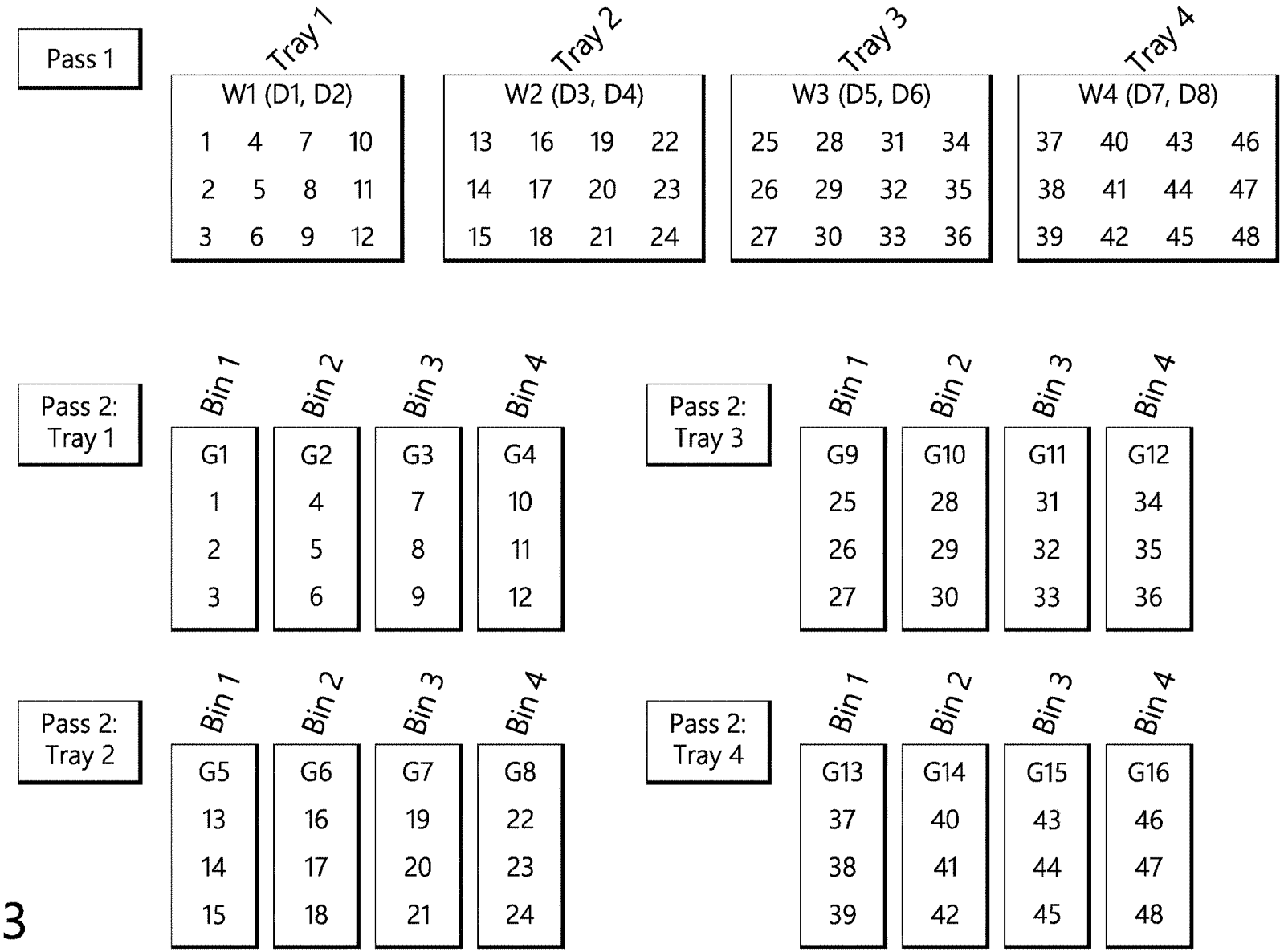
FIG. 3 depicts an embodiment of a two-pass sorting process.

FIG. 3 is a diagram showing an exemplary division of 48 destinations into waves (W1-W4), delivery routes (D1-D8), delivery route segments, and delivery end points. Each number 1 through 48, corresponds to a destination, and the destinations can be numbered according to delivery order sequence. Each numbered delivery end point can represent one item or item intended for delivery to a particular destination, or may represent more than one item for delivery to the particular destination. For example, delivery end point 2 in FIG. 3 may indicate that there is one, or more than one item intended for delivery to delivery end point 2.

Referring now to FIG. 3, in the first pass, the items 215 are fed into the sorter 220 in the random order in which the items were received in bulk. The scanning portion receives the items and scans a destination delivery code, such as a barcode, or reads an address from an item using OCR, and identifies the delivery end point for that item. The processor compares the delivery end point for that item to a sorting plan stored in memory. The sorting plan can include the number of waves for the processing facility, the division of delivery end points into waves, the number of stop groups for the processing facility, the division of delivery end points into stop groups, the delivery routes, and any other desired information. The processor determines which wave the scanned item belongs to, and routes the item to the appropriate tray 236. For example, if the item scanned in the scanning portion is intended for delivery to destination 9, the item is routed in the sorter 220 to Tray 1. Each item is scanned and sorted to the assigned bin or tray. When the bulk stack of items has been fully sorted, bins or trays 1 through 4 will contain items according to the waves assigned to each tray, as shown in FIG. 3. The items in the trays 236 will not necessarily be stacked or ordered according to the ascending or descending delivery sequence for a delivery route. In some embodiments, the items will be randomly arranged within the tray, but each tray will contain only items belonging to the assigned waves. A manifest is created that comprises all the items in a tray and is stored in memory and associated with an identifier for the tray. In some embodiments, the manifest may include information associated with the items, for example, the name of the addressee, delivery end point, special services requested, type of item, description of item, position of item within the tray, etc.

In FIG. 3, Trays 1 through 4 indicate physical trays 236 into which items corresponding to delivery end points 1 through 48 are placed after passing through the sorter 220. As illustrated in FIG. 2, once the items 215 are sorted by the sorter 220 into the trays 236, the items 215 move to the staging farm 240 in preparation for the second pass. After the staging farm 240, the items 215 are sorted by sorter 245 into bins 255. In FIG. 3, Bins 1 through 4 indicate physical bins 255 into which items corresponding to delivery end points 1 through 48 are placed after passing through sorter 245.

A second pass at sorting the items is performed, which may sort or divide the items into stop groups. FIG. 3 shows an exemplary division of delivery end points into stop groups. A stop group may correspond to one or more delivery route segments. In the embodiment illustrated in FIG. 3, each stop group corresponds to one delivery route segment. Stop group G1 includes destinations 1 through 3; stop group G2 includes destinations 4 through 6, stop group G3 includes destinations 7 through 9, etc., up through stop group G16, which includes destinations 46 through 48. Stop group G1 includes the destinations which are the lower numbered destinations (e.g., 1 through 3) for the first delivery route, which corresponds to the first route segment of the first delivery route. Stop group G2 includes the destinations that are the next sequential destinations (e.g. 4 through 6) for the first delivery route D1, which corresponds to the second route segment of the first delivery route D1, and so on for stop groups G1-G16. A person of skill in the art, guided by this disclosure, would understand that other divisions of delivery end points into stop groups are possible.

Once the items have all been sorted with a first pass, the bins 235 are emptied or removed. The bins 235 may be automatically or manually emptied or moved to the storage farm 240. In some embodiments, as shown in FIG. 2, the items from bins 235 may be emptied into trays 236. In some embodiments, the bins 235 and trays 236 will each have a computer readable code thereon or associated therewith. The code may be associated with or correspond to the manifest for that particular bin and/or tray. When the bin's and/or tray's contents are moved or emptied, an automated unloading system may read or scan a computer readable code on the bin and/or tray. This scan event can be stored in a memory to correlate the contents of the bin and/or tray with its manifest. This enables the automation of the next pass as will be described below. The location of each particular bin and/or tray may be stored in a memory, so it can be easily determined where in the storage farm 240 each bin and/or tray is located.

In some embodiments, the automated unloading and transportation equipment may include a location awareness system which logs an event when each tray is loaded and records the location of each tray in the storage farm. For example, when the automated unloading equipment empties bin 1 into tray 1, an event is logged to identify the tray that contains those items. The tray is moved to a location in the storage farm 240, and another event is logged, and the location of the tray having the contents of bin 1 is recorded for later use.

The items can now be sorted further, in what may be called a second pass, into delivery sequence order or other desired order. In some embodiments, multiple trays may be sorted in a single second pass. In some embodiments, a single tray may be sorted in a single second pass. In some embodiments, multiple second passes may be run according to the granularity of the sort on the first pass. In some embodiments, a single second pass may be run.

As illustrated in FIGS. 2 and 3, the trays 236 are retrieved from the storage farm 240. The tray containing the items taken from Tray 1 in the first pass are loaded into the mixed sorter 245 and the second pass for Tray 1 commences. As noted above, the mixed sorter 245 may also comprise an output stacker 250, which is similar to output stacker 230. In some embodiments, each Bin 1 through 4 may receive items intended for a specific stop group. In some embodiments, a stop group may correspond to a delivery route segment. For example, a first delivery route may comprise destinations 1-6, the second delivery route comprises destinations 7-12, etc. As shown in FIG. 3, the first delivery route may comprise two delivery route segments (S1 and S2) and the second delivery route may comprise two delivery route segments (S3 and S4). As shown in FIG. 3, Bin 1 is designated to receive items in S1, the first delivery route segment of the first delivery route, which comprises delivery end points 1-3, and so on for Bins 2 through 4. In some embodiments, the first delivery route may correspond to more or less than destinations 1-6 and more or less than route segments 1-2 without departing from the scope of the present disclosure.

As the items are sorted by mixed sorter 245, each item is scanned, and a computer readable code is read or an OCR image is analyzed to identify the delivery end point for the item. Based on the destination, the item is moved into a particular bin. As additional items are scanned, they are routed to bins according to their destinations.

In some embodiments, the items assigned to delivery end points of stop group G1 are routed to the first bin (Bin 1), and items assigned to delivery end points of stop group G2 are routed to the second bin (Bin 2). The memory associates each item with the corresponding delivery end point (e.g., destination 1-48) for each item as they move into the bins. The sequence, scan, and sort information for each item is stored in memory. Thus, the processor can determine a manifest of the items in each bin 255. In some embodiments, the mixed sorter 245 may print a smart card 600 identifying the items in each bin 255 based on the manifest determined by the processor. In some embodiments, a separate machine may communicate with the processor and create the smart card 600 for the bin 255. The smart card 600 may be added to the bin 255 manually or via automation. Once the items from Tray 1 have been sorted, the bins may be emptied or moved to prepare for another second pass of a different tray from the staging farm 240.

As illustrated in FIG. 3, Tray 2 from the first pass may be loaded into the mixed sorter 245, and the process repeats, with items associated with stop group S5 placed into the first bin (Bin 1) and items associated with stop group S6 placed into the second bin (Bin 2). Trays 3 and 4 are sorted by a similar process, as illustrated in FIG. 3. The items in the bins may not be in delivery sequence order. There may be multiple items per delivery end point, with the items located randomly throughout the bin. The smart card 600 indicates to the delivery carrier at least the delivery end point of an item and the position of that item in the bin. By using the smart card 600, the delivery carrier need not manually sort the items in delivery sequence order, reducing preparation time.

The items from Bins 1-4 from a second pass may be distributed to delivery resources, such as carriers for delivery to the delivery end points. As shown in FIG. 3, by using the described two-pass sorting scheme, items for 48 delivery end points and eight delivery routes can be processed using 4 bins. This sorting method may reduce the space needed and reduce the number of touches on each item.

After the second sort, the items 215 have been sorted to trays or bins according to a delivery sequence, and can be placed directly onto a carrier's vehicle or into a container for further delivery. The carrier may have a tray or bin of letters, flats, or regular mail from a first sorting apparatus, and the items 215, such as parcels, residual mail, etc., from the sorting apparatuses 220 and/or 245, which can be termed a second sorting apparatus. An automated system or the carrier can place trays of regular mail and trays or bins 1-4 having sorted items 215 in a vehicle. The processor and memory can track where the trays or bins 1-4 are placed in the delivery vehicle or other container. The carrier can use this information during subsequent delivery, as will be described elsewhere herein. In some embodiments, a mixed sorter can combine regular mail from the first sorting apparatus and the items 215 from the second sorting apparatus.

In some embodiments, a smart card 600 is created after the second sort. The smart card 600 may be sorted in with the trays of regular mail and indicate to the delivery carrier which delivery addresses have residual mail, where in the tray or bin of residual mail each item is located, and other information. In some embodiments, the smart card 600 is sorted in with the residual mail.

Figure 4:
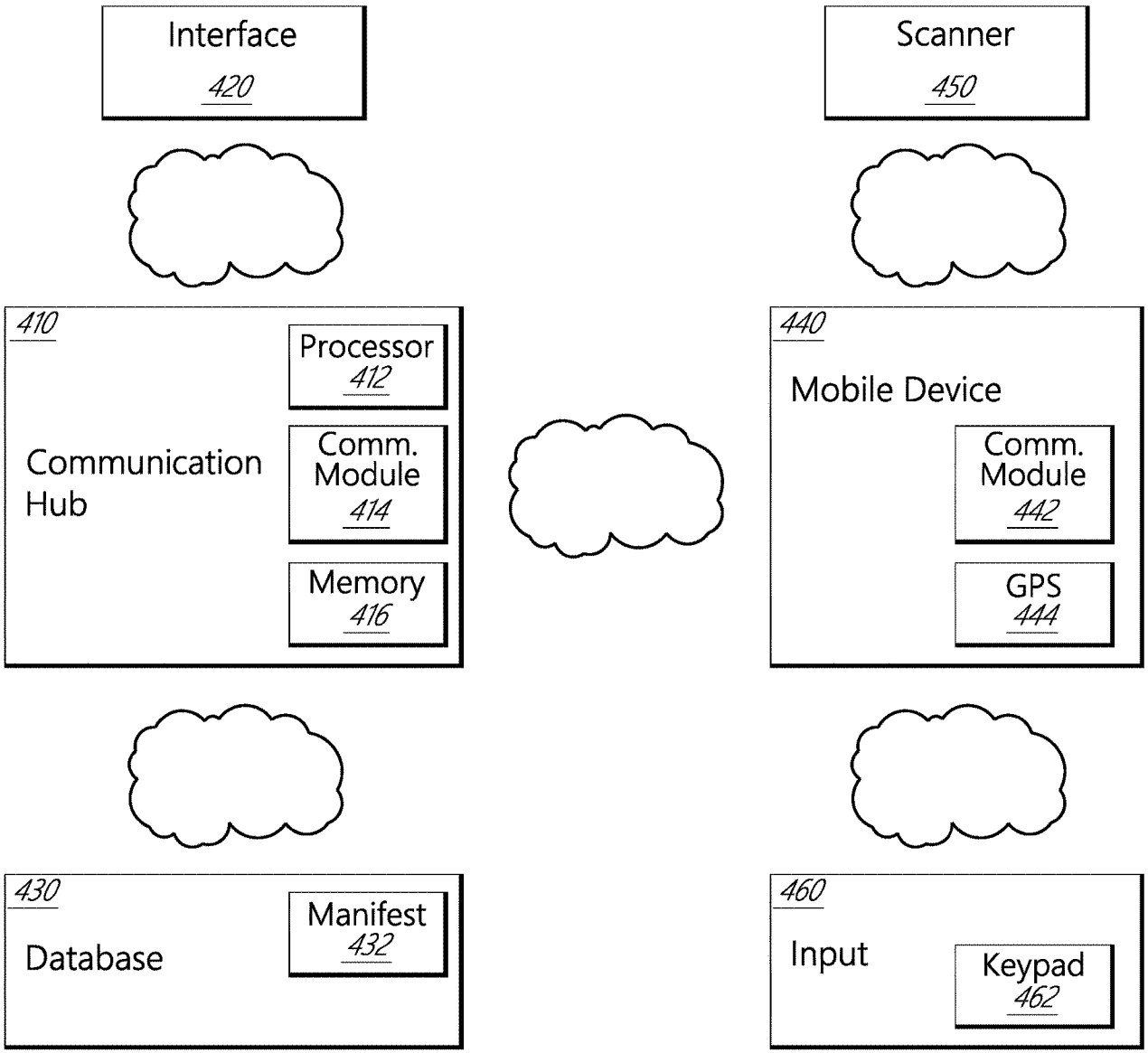
FIG. 4 is a block diagram of an embodiment of a system.

As illustrated in FIG. 4, a system communication hub 410 is in communication, either wired or wirelessly, with at least an item carrier database 430, a communication module 414, and a mobile computing device 440. The system hub 410 may comprise or be a component of a processing system implemented with one or more processors 412. The system hub 410 may be a network of interconnected processors housed on one or more terminals. The one or more processors may be implemented with any combination of general-purpose microprocessors, microcontrollers, digital signal processors (DSPs), field programmable gate arrays (FPGAs), programmable logic devices (PLDs), controllers, state machines, gated logic, discrete hardware components, dedicated hardware finite state machines, or any other suitable entities that may perform calculations or other manipulations of information. The processor 412 may be in communication with a memory 416, which may include, for example, RAM memory, flash memory, ROM memory, EPROM memory, EEPROM memory, registers, hard disk, a removable disk, a CD-ROM, or any other form of storage medium known in the art. The memory 416 may include, for example, software, at least one software module, instructions, steps of an algorithm, or any other information. In some embodiments, the processor 412 performs processes in accordance with instructions stored in the memory 416.

The system hub 410 may be in communication with the database 430. In some embodiments, the database 430 may comprise a processor, memory, and other components similar to those described herein for the system hub 410. In some embodiments, the database may be configured to use the processor, memory, and other components of the system hub 410, or a combination of its own components and the system hub's components.

In some embodiments, the database 430 contains information on factors that can affect delivery alerts. For example, the database 430 may contain information on the stopping points along the carrier's route, the addresses associated with each delivery route segment, the distance from a location to a delivery stopping point, distances based on speed to determine an anticipated time to the next destination, in order to generate alerts for a carrier.

The mobile computing device 440 is in communication with the system hub 410 The mobile computing device comprises a communication module 442 and GPS module 444. The GPS module 444 is configured to determine and store the location of the mobile device 440. The mobile computing device may further comprise a scanner 450 configured to scan a physical item. The mobile device 440 may communicate with the scanner 450. The mobile device may further comprise an input 460. The mobile device may communicate with the input 460, which has a keypad 462 or other mechanism for data input.

In some embodiments, the item-carrier database 430 is configured to store information about the entities that will deliver items. In some embodiments, these entities are delivery persons or delivery services. In some embodiments, the item carrier database 430 is configured to store information about the geographical routes that the entities deliver items on. For example, the item-carrier database 430 can store a set of addresses that are assigned to a particular item carrier to deliver items to, such as a pre-determined route. In some embodiments, the item carrier database 430 can store a different geographical route for each item carrier for each day of the week. The item carrier database 430 can also store an actual and a scheduled departure time for each item carrier on their route on a given day. In some embodiments, the item carrier database 430 can also contain records of timesheets that confirms when various entities worked at what times.

In some embodiments, the item carrier database 430 is configured to store information about the sorted items to be delivered. In some embodiments, the item carrier database 430 is configured to store information about which items are located in which bin or tray, as sorted by the sorting equipment, and where the bin or tray is located, such as in a storage area, a loading dock, a vehicle, a pallet, a container, and the like. In some embodiments, the location of the item and/or bin may be updated each time the item and/or bin is moved. In some embodiments, the item carrier database may comprise a manifest 432, which corresponds to or is compiled from manifests generated by the sorting equipment described herein which identify which of items 215 are to be delivered to delivery points for each delivery route. For example, the manifest 432 stores information about the items in each tray that a delivery carrier is delivering. The manifest 432 may comprise information about the items, for example, name of the addressee, special services requested, delivery destination, type of item, description of item, etc.

To continue to use the USPS example, a delivery carrier may take the items from Bin 1 and Bin 2 of the second pass of Tray 1, as shown in FIG. 3, for delivery. The items, 1-6, may not be in delivery sequence order and may be separate from the carrier's other items, such as standard letters or flats, intended for delivery along the carrier's delivery route. It would take extra time for the carrier to put the items into sequence and to combine the items with the carrier's other deliveries, particularly when there are many parcels, packages, or residual mail for delivery on a specific day or along a specific route. The carrier may use the mobile device 440 to communicate with the database 430 and retrieve the manifest 432 for the items that were in trays or bins 1 and 2 (or any bins associated with the carrier's delivery route) and to provide notifications or alerts to deliver the items in trays or bins 1 and 2.

Figure 5:
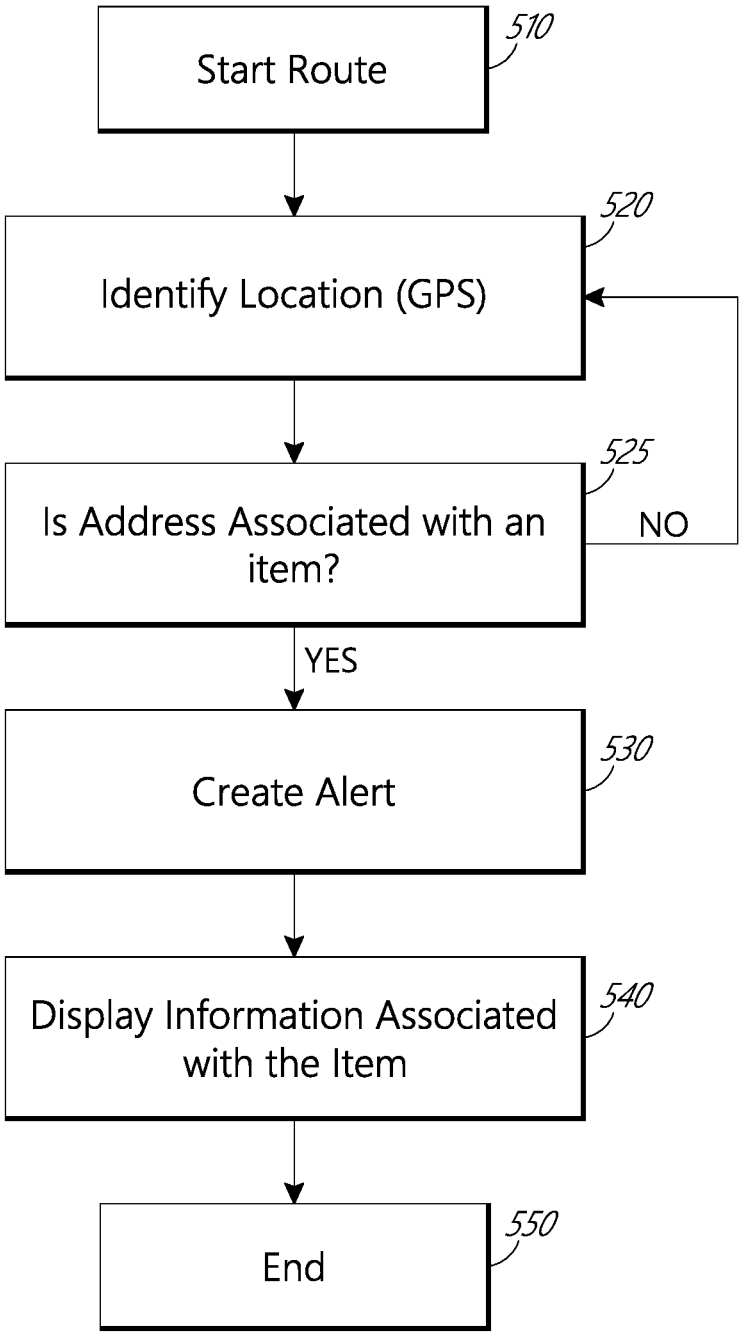
FIG. 5 is a flow chart illustrating an embodiment of a process triggering a delivery alert.

As illustrated in FIG. 5, process 500 begins when the carrier starts her route in step 510. As the carrier travels along the carriers delivery route, generally along a known path to known delivery points, the process moves to step 520, wherein the GPS module 444 identifies the location of the mobile device 440, which is being carried or transported by the carrier. The mobile device 440 can communicate the location of the carrier continuously, at intervals, or it can be requested by the communication hub 210. The communication hub 410 can communicate the location of the mobile device 440 to the item carrier database 430. In some embodiments, the manifest for a delivery route is stored locally on the mobile device 440, or is stored remotely and accessed wirelessly by the mobile device 440. The mobile device 440 or the item carrier database 430 can identify the location of the mobile delivery device as corresponding to a delivery point or an address. The location can be identified when the mobile device 440 enters into a geofence associated with the delivery point, address, or location to which delivery is intended. In some embodiments, the mobile device 440 can determine it is near a delivery point or address based on the distance and/or time since the previous address or delivery, which may be associated with a scan of an item. In some embodiments, the location can be identified at a predetermined time before the carrier will be at a particular location, such as the immediately preceding location, or 1 to 2 minutes before the carrier is to arrive at a location. The mobile device 440 can anticipate what the upcoming location, delivery point, or address is, based on GPS coordinates and the carrier's route, and query the manifest 432 before the carrier is actually physically at a particular location or delivery point.

When the location of the mobile device 440 is identified, in step 520, the process 500 moves to decision state 525, wherein the mobile device 440 or the item carrier database 430 determines whether the location identified in step 520 is associated with an item in the manifest 525, or, in other words, with an item intended for delivery along the carrier's route. The mobile device 440 can query the manifest according to the delivery point, using the address, geographic coordinates, and the like. In some embodiments, the mobile device 440 can sent a request to the item carrier database 430, which will query the manifest and determine if an item is intended for delivery to the delivery point associated with or corresponding to the location of the mobile device 440.

If no item for the location of the mobile device 440 is on the manifest, or no item is intended for delivery to the delivery point where the mobile device 440 is located, then the mobile device returns to step 520 and the process repeats.

If the location identified in step 520 is associated with an item in the manifest, the process 500 moves to step 530, wherein the mobile device 440 creates an alert. The alert can warn or notify the carrier that an item intended for delivery to the location is on the manifest, is in a bin or tray on the carrier's vehicle, or in another container.

The process 500 moves to step 540, wherein the mobile device 440 displays information such as addressee name, item identification, the bin or tray the item is located in, delivery destination, type of item, description of the item, special services requested, etc. This information can assist the carrier to quickly and efficiently find the item, such as the package, parcel, or residual mail item, in the carrier's vehicle, or to allow an automated system in the vehicle to collect or pick the item for delivery. In some embodiments, the carrier may have regular mail, such as letters and flats, to deliver to the location, along with an item of residual mail or a parcel. As described above, the letters and flats can be sorted separately and loaded onto a vehicle separately. With the mobile device 440 providing an alert, a carrier does not need to handle all the items of residual mail, or sort through all the parcels checking whether a parcel or other item is to be delivered to a particular location. The carrier, when delivering regular mail to a location sees the alert indicating the bin the item is in, can immediately go to the right bin and select the item, and deliver the item and the other mail together. In some embodiments, the carrier may be delivering along a parcel-only route, and may not have regular letters or flats to deliver. In this case, the carrier can travel the route without stopping for each location, and without looking at all the parcels or residual mail to decide where to stop. Instead, the carrier can travel along the parcel-only route and be alerted when the carrier nears or is at a location to which a parcel or residual mail item is to be delivered.

These steps may be repeated until the carrier completes her delivery route or all items in the manifest have been delivered. The alert is beneficial because it does not require the carrier to memorize what items she has for delivery. The carrier will be alerted by the mobile device that there is an item that needs to be delivered before or when she is at the delivery location. The alert is beneficial because it does not require items to be in sequence, which will shorten delivery times. The carrier does not need to spend time sorting and sequencing items.

FIG. 6 depicts an embodiment of a smart card. The smart card 600 can be a physical card inserted into a delivery resource's container, tray, vehicle, or other device holding items to be delivered. In some embodiments, the information contained on the smart card 600 can be electronically sent to a mobile delivery device of a delivery resource.

The smart card 600 includes information identifying the items in the tray 236. For example, as will be described in greater detail below, the smart card 600 may include the delivery end point 610 for the items contained within the tray 246, the position of the items 620 in the tray, and other information 630. The other information may include the number of items for each delivery end point, total number of items in the stack, customer information, route information, the name of the addressee, special services requested, type of item, description of item, etc.

To illustrate, a delivery resource may be walking or driving along a delivery route. At a particular delivery destination, the delivery resource can look at the smart card 600 to quickly ascertain whether there are any residual mail items to be delivered to that delivery destination, as will be shown in the delivery end point column. If so, the smart card 600 will then list the position of the item in the tray 236. For example, the smart card 600 may say that the item is the tenth item in the tray 236. In some embodiments, the smart card 600 may list the relative position of the item in the tray 236. For example, the smart card 600 may indicate that the item is located in the front third, the middle, or the rear third (or any other delineation of tray areas). In some embodiments, the position of item column 620 includes the positions of items within the vehicle. For example, the residual items may be distributed through the vehicle, and the positions of the items are present on the smart card 600. The smart card 600 can indicate the shelf on which a particular item is located, or in which section of the vehicle the item is looking. The delivery resource can quickly then identify and retrieve the residual mail item for delivery to the end point. In some embodiments, the smart card 600 can be taller than the items in the tray 236 so the smart card 600 is visible over the tops of the other items when the smart card 600 is present in the tray.

If there are any particular instructions or other important information, that information can be included on the smart card 600 in the other information column 630. The information included here may be special delivery instructions, signature requirements, the presence of an obstacle or dangerous animal at the delivery end point, or any other desired information.

In some embodiments, the information from the smart card 600 may be provided to the mobile delivery device of the delivery resource. As described elsewhere herein, the mobile delivery device can provide an alert to the delivery resource regarding residual mail items.

The technology is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, programmable consumer electronics, network PCs, minicomputers, mainframe computers, distributed computing environments that include any of the above systems or devices, and the like.

The present disclosure refers to processor-implemented steps for processing information in the system. Instructions can be implemented in software, firmware or hardware and include any type of programmed step undertaken by components of the system.

The one or more processors may be implemented with any combination of general-purpose microprocessors, microcontrollers, digital signal processors (DSPs), field programmable gate arrays (FPGAs), programmable logic devices (PLDs), controllers, state machines, gated logic, discrete hardware components, dedicated hardware finite state machines, or any other suitable entities that may perform calculations or other manipulations of information. The system hub 110 may comprise a processor 111 such as, for example, a microprocessor, such as a Pentium® processor, a Pentium® Pro processor, a 8051 processor, a MIPS® processor, a Power PC® processor, an Alpha® processor, a microcontroller, an Intel CORE i7®, i5®, or i3® processor, an AMD Phenom®, A-Series®, or FX® processor, or the like. The processor 111 typically has conventional address lines, conventional data lines, and one or more conventional control lines.

The system may be used in connection with various operating systems such as Linux®, UNIX®, MacOS®, or Microsoft Windows®.

The system control may be written in any conventional programming language such as C, C++, BASIC, Pascal, or Java, and ran under a conventional operating system. C, C++, BASIC, Pascal, Java, and FORTRAN are industry standard programming languages for which many commercial compilers can be used to create executable code. The system control may also be written using interpreted languages such as Perl, Python or Ruby.

Those of skill will further recognize that the various illustrative logical blocks, modules, circuits, and algorithm steps described in connection with the embodiments disclosed herein may be implemented as electronic hardware, software stored on a computer readable medium and executable by a processor, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such embodiment decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

If implemented in software, the functions may be stored on or transmitted over as one or more instructions or code on a computer-readable medium. The steps of a method or algorithm disclosed herein may be implemented in a processor-executable software module which may reside on a computer-readable medium. Memory Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A system for sorting and delivering items comprising:
a sorter comprising:
a first scanner configured to scan a plurality items and identify a destination for each of the plurality of items;
a processor in communication with the first scanner, and configured to associate the identified destination for each of the plurality of items with one of a plurality of stop groups;
a sorting portion configured to receive items from the scanner, and sort the plurality of items into a plurality of bins according to the associated stop groups, wherein the plurality of items in at least one bin of the plurality of bins forms a stack of items; and
a sorter memory configured to store the location of the plurality of items in the plurality of bins; and
a server memory storing a manifest for the stack of items, the manifest comprising:
a sequenced list of the destinations for each of the plurality of items in the stack;
item position information including a relative position within the stack of each of the plurality of items in the stack; and
delivery information for each of the plurality of items in the stack;
wherein the server memory is in communication with a mobile delivery device configured to:
receive at least a portion of the manifest;
determine, based on a geographic location of the mobile delivery device, that an item associated with the geographic location of the mobile delivery device is in the stack of items; and
provide, based on the item position information, a notification of the relative position within the stack of the item associated with the geographic location of the mobile delivery device.

2. The system of claim 1 wherein the sorting portion comprises:
an output sorter configured to select a leading item from the scanner and direct the item toward the plurality of bins.

3. The system of claim 2 wherein the processor is configured to store a sequence of the destinations for the plurality of items, and to receive the associated stop group for each of the plurality of the items, and to control the output sorter to sort the plurality of items to one of the one or more bins according to the stop group associated for each of the plurality of items.

4. The system of claim 1, wherein the sequenced list of the destinations for each of the plurality of items in the stack is a walk sequence order.

5. The system of claim 2, wherein the output sorter is configured to sort items associated with one or more stop groups into one of the plurality of bins.

6. The system of claim 1, further comprising a database comprising:
a processor; and
a memory configured to store the manifest.

7. The system of claim 1, wherein the mobile delivery device is configured to store the portion of the manifest.

8. The system of claim 6, wherein the mobile delivery device is configured to communicate with the database.

9. The system of claim 1 further comprising:

a printer configured to print the manifest on a card; and the card, wherein the card is sorted in the stack of items.

10. The system of claim 4, wherein the plurality of items in the stack of items are sorted non-sequentially of the walk sequence order.

11. The system of claim 4, wherein the delivery information for each of the plurality of items in the stack is a description of the item, a special delivery instruction, or a type of item.

12. The system of claim 1 further comprising a mobile delivery device configured to:

detect the geographic location of the mobile delivery device;

determine whether an item associated with the geographic location of the mobile delivery device is in the stack of items; and display the position in the stack of the item associated with the geographic location of the mobile delivery device.

13. The system of claim 6 further comprising a mobile delivery device configured to:

detect the geographic location of the mobile delivery device;

determine whether an item associated with the geographic location of the mobile delivery device is in the stack of items; and display the position in the stack of the item associated with the geographic location of the mobile delivery device.

14. A system for sorting and delivering items comprising:

a sorter comprising:

a first scanner configured to scan a plurality items and identify a destination for each of the plurality of items;

a processor in communication with the first scanner, and configured to associate the identified destination for each of the plurality of items with one of a plurality of stop groups;

a sorting portion configured to receive items from the scanner, and sort the plurality of items into a plurality of bins according to the associated stop groups, wherein the plurality of items in at least one bin of the plurality of bins forms a stack of items;

a first memory configured to store the location of the plurality of items in the plurality of bins;

a manifest stored in a second memory remote from the sorter, the manifest comprising a sequenced list of the destinations for each of the plurality of items in the stack, a relative position within the stack of each of the plurality of items in the stack, and delivery information for each of the plurality of items in the stack; and a mobile delivery device in communication with the second memory, the mobile delivery device configured to:

receive at least a portion of the manifest;

determine a geographic location of the mobile delivery device;

determine that an item associated with the geographic location of the mobile delivery device is in the stack of items; and provide, based on the portion of the manifest, a notification of the relative position within the stack of the item associated with the geographic location of the mobile delivery device.

15. The system of claim 14 further comprising:

a printer configured to print, onto a card, information identifying individual items within the stack of items; and the card, wherein the sorter is configured to sort the card into the stack of items.

* * * * *